US010519798B2

(12) United States Patent
Kennedy

(10) Patent No.: US 10,519,798 B2
(45) Date of Patent: Dec. 31, 2019

(54) GAS TURBINE ENGINE WITH VARIABLE GUIDE VANES AND A UNISON RING

(71) Applicant: ROLLS-ROYCE plc, London (GB)

(72) Inventor: Michael G. Kennedy, Nottingham (GB)

(73) Assignee: ROLLS-ROYCE PLC, London (GB)

( * ) Notice: Subject to any disclaimer, the term of this patent is extended or adjusted under 35 U.S.C. 154(b) by 195 days.

(21) Appl. No.: 15/699,295

(22) Filed: Sep. 8, 2017

(65) Prior Publication Data

US 2018/0080338 A1 Mar. 22, 2018

(30) Foreign Application Priority Data

Sep. 22, 2016 (GB) ..... 1616108.5

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2220/323* (2013.01); *F05D 2230/60* (2013.01); *F05D 2240/12* (2013.01)

(58) Field of Classification Search
CPC ..... F01D 17/162; F05D 2220/323; F05D 2230/60; F05D 2240/12; F05D 2260/30
USPC ..... 415/148
See application file for complete search history.

(56) References Cited

U.S. PATENT DOCUMENTS 2,209,274 A * 7/1940 Jaberg ..... H02G 3/06 174/83
2,933,234 A * 4/1960 Neumann ..... F01D 17/162 415/149.4
2,936,108 A * 5/1960 Swain, Jr. ..... F01D 17/162 415/137
2,950,084 A * 8/1960 Perry ..... A41D 31/00 415/160
3,013,771 A * 12/1961 Henny ..... F01D 17/162 415/149.1
3,314,595 A * 4/1967 Burge ..... F01D 17/162 415/160
3,502,260 A * 3/1970 Koff ..... F01D 17/162 415/148
4,049,360 A * 9/1977 Snell ..... F01D 17/162 415/149.4
4,050,844 A * 9/1977 Miller ..... F01D 17/162 415/147
4,137,602 A * 2/1979 Klumpp, Jr. ..... B65D 39/04 16/2.1

(Continued)

FOREIGN PATENT DOCUMENTS

EP 2481891 8/2012

OTHER PUBLICATIONS

Great Britain Search Report dated Dec. 21, 2016, issued in GB Patent Application No. 1616108.5.

*Primary Examiner* — Hung Q Nguyen
*Assistant Examiner* — Susan E Scharpf
(74) *Attorney, Agent, or Firm* — Oliff PLC

(57) ABSTRACT

A gas turbine engine comprises a plurality of variable guide vanes, a unison ring, and a lever arrangement connecting the unison ring to the variable guide vanes. The lever arrangement comprises a lever pin received by the unison ring, and a bush provided between the lever pin and the unison ring. The bush comprises a sprung region biased outwardly away from the lever pin towards the unison ring.

20 Claims, 4 Drawing Sheets

(56) References Cited

U.S. PATENT DOCUMENTS 4,756,640 A * 7/1988 Gehrke ..... F16B 21/16 403/326
4,813,808 A * 3/1989 Gehrke ..... F16B 21/16 24/625
4,836,746 A * 6/1989 Owsianny ..... F01D 17/162 415/149.2
5,342,169 A * 8/1994 Muller ..... F01D 17/162 415/160
5,593,275 A * 1/1997 Venkatasubbu ..... F01D 17/162 415/160
5,931,636 A * 8/1999 Savage ..... F01D 17/141 415/115
6,019,574 A * 2/2000 DiBella ..... F01D 17/162 415/148
8,172,517 B2 * 5/2012 Lighty ..... F01D 17/162 415/156
8,251,647 B2 * 8/2012 Jarusel ..... F01D 17/162 415/160
2001/0040359 A1 * 11/2001 Hildebrand ..... B60G 7/001 280/686
2003/0131443 A1 * 7/2003 Trent ..... B60R 13/0846 16/2.1
2005/0008489 A1 * 1/2005 Perruchaut ..... F01D 17/16 416/160
2008/0053107 A1 * 3/2008 Weaver ..... F01D 9/023 60/800
2009/0318238 A1 * 12/2009 Bolgar ..... F01D 17/162 464/37
2012/0195751 A1 * 8/2012 Gasmen ..... F01D 17/162 415/213.1
2013/0115056 A1 * 5/2013 Hashimoto ..... F16H 21/44 415/150
2013/0149023 A1 * 6/2013 Wiecko ..... F16C 11/02 403/79
2015/0121836 A1 * 5/2015 Moreau ..... F16G 15/06 59/86
2016/0215471 A1 * 7/2016 Gaucherand ..... E02D 5/80

* cited by examiner

GAS TURBINE ENGINE WITH VARIABLE GUIDE VANES AND A UNISON RING

CROSS-REFERENCE TO RELATED APPLICATIONS

This specification is based upon and claims the benefit of priority from UK Patent Application Number GB1616108.5 filed on 22 Sep. 2016, the entire contents of which are incorporated herein by reference.

BACKGROUND OF THE INVENTION

Field of Disclosure

The present disclosure concerns a gas turbine engine, a compressor, and/or a method of manufacturing a gas turbine engine and/or a compressor.

Description of Related Art

Gas turbine engines are typically employed to power aircraft. Typically a gas turbine engine will comprise an axial fan driven by an engine core. The engine core is generally made up of one or more turbines which drive respective compressors via coaxial shafts. The fan is usually driven off an additional lower pressure turbine in the engine core.

A compressor typically comprises a series of arrays of blades each having an aerofoil cross section. The blades are attached to a central hub or drum. The blades accelerate the air through the engine. Each of the arrays of blades are coupled with an array of vanes that are also of aerofoil cross section. The vanes are connected to radially inner and/or outer casings.

The vanes may be variable guide vanes. That is, the vanes may be moveably attached to the inner and/or outer casing such that each vane can rotate relative to the casing about an axis local to the vane. Rotating the vanes can vary the angle of approach of air to the vane as seen from the vane, and/or vary the exit angle of air from between the vanes, so as to optimise performance of the engine at a given operating condition.

Generally, each of the vanes are pivotally connected via a lever arrangement to a unison ring. The unison ring moves circumferentially (either anti-clockwise or clockwise as desired) so as to change the angle of the vanes. A lever pin (forming part of the lever arrangement) is mounted to the unison ring. A bush is provided between the lever pin and the unison ring. Retention features are provided to axially retain the pin with respect to the unison ring. However, in current designs, the retention features can often be damaged during assembly, which can reduce their effectiveness.

BRIEF SUMMARY OF THE DISCLOSURE

According to a first aspect there is provided a gas turbine engine comprising a plurality of variable guide vanes, a unison ring; and a lever arrangement connecting the unison ring to the variable guide vanes. The lever arrangement comprises a lever pin received by the unison ring. A bush is provided between the lever pin and the unison ring. The bush comprises a sprung region biased outwardly away from the lever pin towards the unison ring.

Outwardly away may be referred to as locally radially outwardly with respect to the lever pin.

The sprung region may be adjacent the unison ring (e.g. to an inner surface of the unison ring) at a position proximal to a point of connection of the lever arrangement with the variable guide vanes.

The bush may comprise a further sprung region biased outwardly way from the lever pin towards the unison ring. The further sprung region may be adjacent the unison ring (e.g. an outer surface of the unison ring) at a position distal to a point of connection of the lever arrangement with the variable guide vanes.

The sprung region of the bush may define a leaf spring.

An outer surface of the sprung region of the bush may comprise a ramped section which increases in thickness at a position proximal to a point of connection of the lever arrangement with the variable guide vanes.

The bush may comprise a first retention protrusion adjacent an inner surface of the unison ring and proximal to connection of the lever arrangement to the variable guide vanes.

The first retention protrusion may be defined by an outer surface of the sprung region.

The bush may comprise a second retention protrusion adjacent an outer surface of the unison ring and proximal to a connection of the lever arrangement to the variable guide vanes.

The second retention protrusion may define a flange or a head. The flange or head may have a cannelure.

The cannelure may be considered to be a circumferential groove.

The cannelure may be provided at a position adjacent to an opening in the unison ring that receives the bush.

The bush may comprise a third retention protrusion adjacent an inner surface of the unison ring and distal to a connection of the lever arrangement to the variable guide vanes.

The bush may comprise a fourth retention protrusion adjacent an outer surface of the unison ring and distal to a connection of the lever arrangement to the variable guide vanes.

The unison ring may define a first hole proximal to the connection of the lever arrangement with the variable guide vanes and a second hole distal to the connection of the lever arrangement with the variable guide vanes (e.g. axially displaced from the first hole). The lever pin and bush may be received through the first hole and the second hole.

The first hole of the unison ring may have a larger diameter than the second hole of the unison ring.

The bush may have a greater thickness (e.g. wall thickness) in a region aligned with the first hole than in a region aligned with the second hole.

The holes may be circular in cross section.

A chamfer may be provided around the edge of the first hole and/or the second hole. The chamfer may be at an angle of 5 to 30 degrees to an axis parallel to a longitudinal axis of the gas turbine engine.

The bush may include a recess at one or both longitudinal ends.

The recess may be a chamfered recess.

The fourth retention protrusion and the recess at the end of the bush distal to a point of connection with the lever arrangement may define the further sprung region of the bush.

According to an aspect there is provided a method of manufacturing a gas turbine engine according to the previous aspect. The method comprises compressing the sprung region of the bush and inserting the bush into the unison ring whilst the sprung region is compressed.

The sprung region may be compressed using a mandrel.

The mandrel may be received in a guide that guides the mandrel and bush through the unison ring.

The skilled person will appreciate that except where mutually exclusive, a feature described in relation to any one of the above aspects may be applied mutatis mutandis to any other aspect. Furthermore except where mutually exclusive any feature described herein may be applied to any aspect and/or combined with any other feature described herein.

BRIEF DESCRIPTION OF THE DRAWINGS

Embodiments will now be described by way of example only, with reference to the Figures, in which.

DETAILED DESCRIPTION

Figure 1:
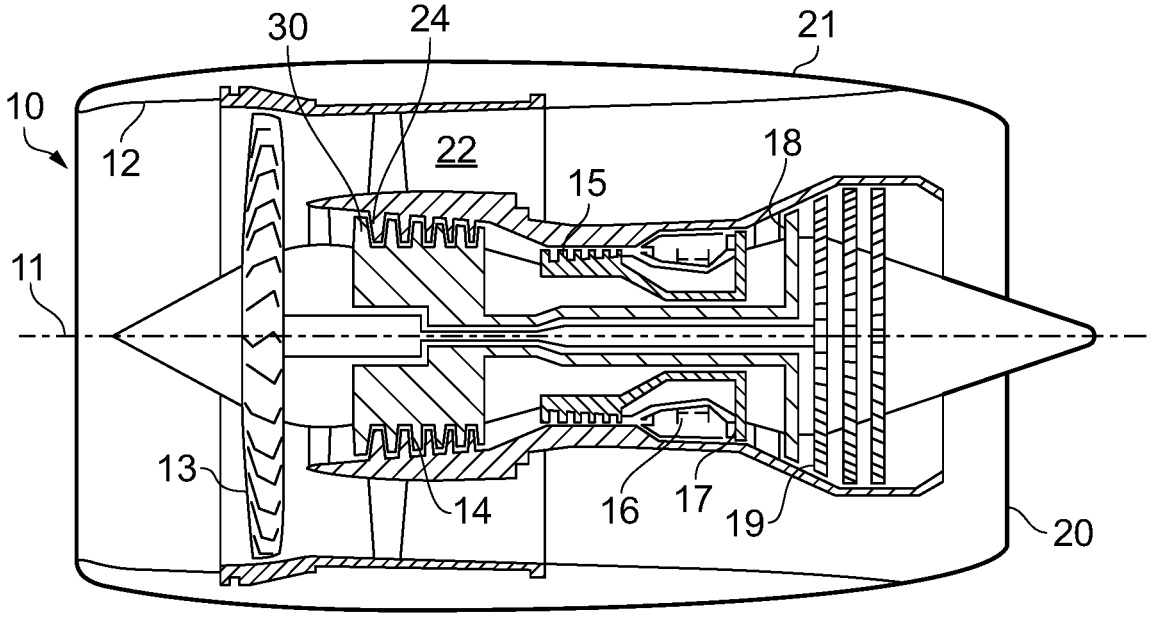
FIG. 1 is a sectional side view of a gas turbine engine.

With reference to FIG. 1, a gas turbine engine is generally indicated at 10, having a principal and rotational axis 11. The engine 10 comprises, in axial flow series, an air intake 12, a propulsive fan 13, an intermediate pressure compressor 14, a high-pressure compressor 15, combustion equipment 16, a high-pressure turbine 17, an intermediate pressure turbine 18, a low-pressure turbine 19 and an exhaust nozzle 20. A nacelle 21 generally surrounds the engine 10 and defines both the intake 12 and the exhaust nozzle 20.

The gas turbine engine 10 works in the conventional manner so that air entering the intake 12 is accelerated by the fan 13 to produce two air flows: a first air flow into the intermediate pressure compressor 14 and a second air flow which passes through a bypass duct 22 to provide propulsive thrust. The intermediate pressure compressor 14 compresses the air flow directed into it before delivering that air to the high pressure compressor 15 where further compression takes place.

The compressed air exhausted from the high-pressure compressor 15 is directed into the combustion equipment 16 where it is mixed with fuel and the mixture combusted. The resultant hot combustion products then expand through, and thereby drive the high, intermediate and low-pressure turbines 17, 18, 19 before being exhausted through the nozzle 20 to provide additional propulsive thrust. The high 17, intermediate 18 and low 19 pressure turbines drive respectively the high pressure compressor 15, intermediate pressure compressor 14 and fan 13, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

In the present description, unless a reference to an alternative component is given, an axial direction is parallel to a longitudinal axis of the gas turbine engine, a circumferential direction circumscribes the gas turbine engine, and a radial direction is with respect to the gas turbine engine and is perpendicular to the circumferential and axial direction.

Figure 2:
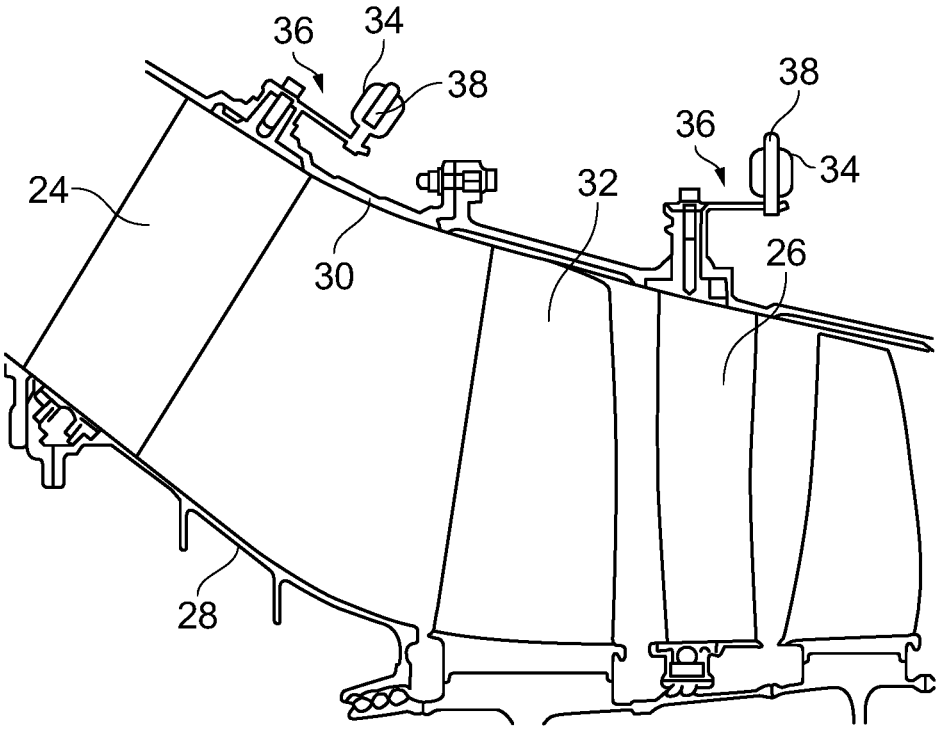
FIG. 2 is a partial sectional side view of a variable inlet guide vane and a partial section of variable vanes and blades.

Referring to FIG. 2, the compressor 14, 15 may have variable guide vanes 24, 26, including variable inlet guide vanes 24. In the present example the compressor has an inner casing 28 and an outer casing 30, and the variable guide vanes are provided in the passage defined by the inner casing and the outer casing. The variable guide vanes 24, 26 are provided in circumferential rows, and between the rows of vanes a circumferential row of blades 32 are provided.

Unison rings 34 circumscribe the outer casing 30 of the compressor. That is, the unison rings are provided so as to be radially outward of the outer casing of the compressor. In the present example, each unison ring is associated with one row of variable guide vanes. A lever arrangement 36 connects the unison ring to the respective variable guide vanes 24, 26. The lever arrangement includes a lever pin 38 that is received in the unison ring 34. The lever arrangement includes pivotal connections and levers, arranged such that circumferential movement of the unison ring, e.g. in a clockwise or anticlockwise direction causes the levers to move and rotate the variable guide vanes 24, 26.

Figure 3:
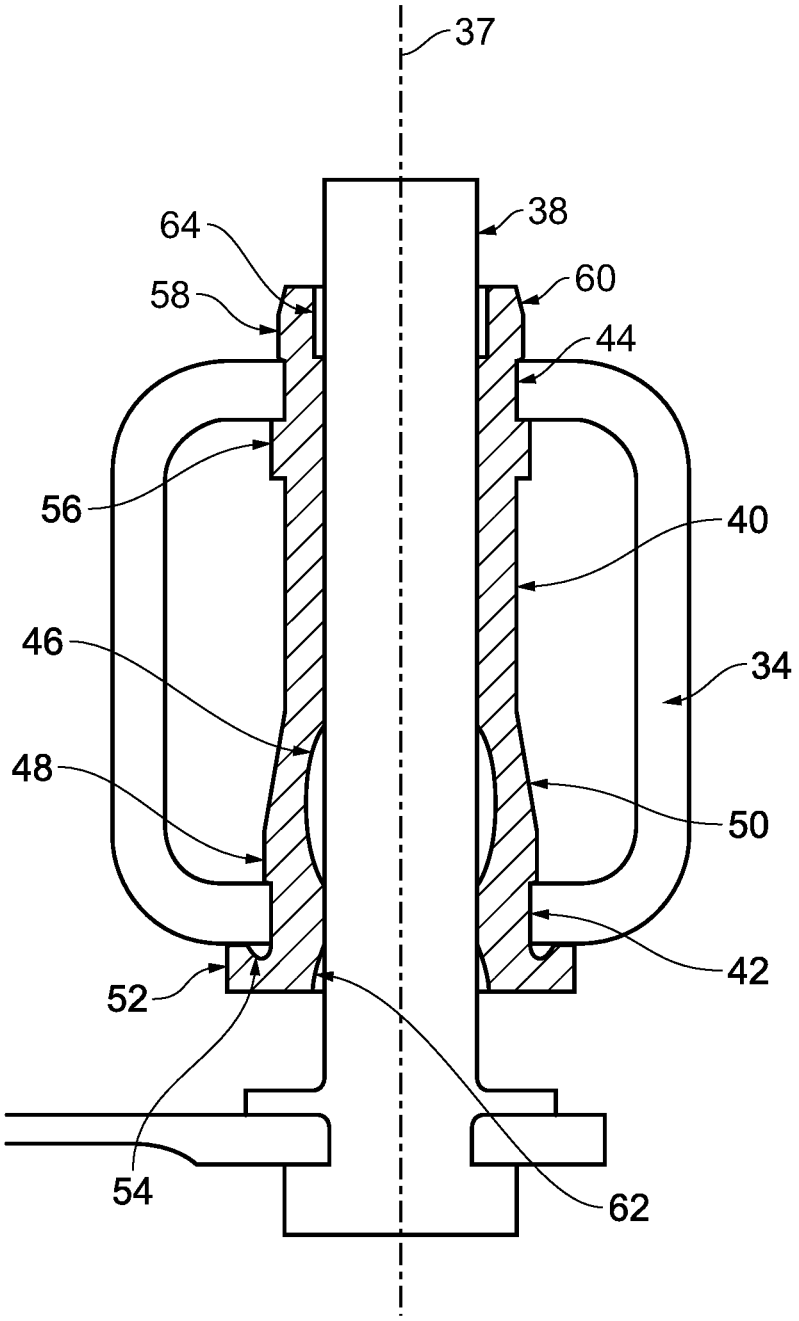
FIG. 3 is a sectional view of a unison ring, lever pin and bush assembly.

Referring to FIG. 3, a bush 40 is provided between the unison ring 34 and each lever pin 38. The bush and lever pin extend beyond the full radial width of the unison ring.

In the present example, the unison ring 34 is a hollow ring with a substantially rectangular cross section with curved corners. The bush 40 is received in the unison ring through a hole 42 in a radially inner face and a hole 44 in radially outer face. The holes are circular. In the present example, the diameter of the hole 42 is greater than the diameter of the hole 44. Each of the holes 42, 44 include a chamfered edge to define a lead-in for the bush during assembly. As such, the chamfered edge of the hole 42 is provided adjacent an outer surface of the unison ring and the chamfered edge of the hole 44 is provided adjacent an inner surface of the unison ring. The chamfer is a shallow chamfer, i.e. less than 45 degrees, for example 5 to 30 degrees to a longitudinal axis 37 of the lever pin 38.

The lever pin 38 is cylindrical in cross section. The lever pin extends through and beyond the bush 40 and connects to a remainder of the lever arrangement.

The bush 40 is substantially cylindrical in cross section. The bush includes a sprung region, which in this example is formed by a leaf spring 46. The leaf spring is an integral component of the bush 40. The leaf spring is positioned adjacent the hole 42 and an inner surface of the unison ring. In the present example, the leaf spring extends with a longitudinal length of approximately one quarter to a half, e.g. one third of the radial width of an inner volume defined by the unison ring 34. The leaf spring biases a portion of the bush away from the lever pin 38 and towards the unison ring 34.

A radially outer surface of the bush in the region of the leaf spring defines a first retention protrusion 48. A face of the first retention protrusion is adjacent to and may abut against the inner surface of the unison ring at a position adjacent to the hole 42.

The bush 40 also includes a ramped portion 50 provided adjacent to the first retention protrusion 48 and on an outer surface (i.e. a surface proximal to the unison ring and distal to the pin) of the bush. The ramped surface is such that the bush has an increased wall thickness at a radially inner position (i.e. proximal to the remainder of the lever arrangement) than at a radially outer position (i.e. distal to the remainder of the lever arrangement). Indeed, the bush is thicker at one longitudinal end than the other, such that the wall thickness of the bush is greater in the region of the hole 42 of the unison ring than in the region of the hole 44 of the unison ring.

The bush 40 includes a second retention protrusion 52. The second retention protrusion is provided at a longitudinal end of the bush and may be considered to define a flange. The second retention feature is adjacent to, and in this example abuts, an outer face of the unison ring. The second retention feature includes a cannelure 54, which may be considered to be a groove, for example a groove of semi-circular cross section. The cannelure defines a closed loop around the bush. The cannelure is provided adjacent to (in an axial direction) the hole 42 of the unison ring.

The bush includes a third retention protrusion 56 positioned towards an opposite longitudinal end to the first 48 and second 52 retention protrusions. The third retention protrusion is adjacent to, and may abut an inner surface of the unison ring. The third retention protrusion is adjacent to the hole 44 of the unison ring. The bush further includes a fourth retention protrusion 58. The fourth retention protrusion is provided at the same longitudinal end as the third retention protrusion and is provided adjacent to the hole 44. The fourth retention feature is provided adjacent to and may abut against an outer surface of the unison ring 34.

The fourth retention protrusion 58 includes a ramped surface 60 adjacent to the end of the longitudinal end of the bush 40. The ramped surface decreases the outer diameter and the wall thickness of the bush in a direction towards the longitudinal end of the bush distal from the lever arrangement.

A recess 64 is provided at the same axial position as the fourth retention protrusion. The recess is provided on an inner surface of the bush adjacent the edge distal to the lever arrangement. The recess extends to a position substantially adjacent to the hole 44 in the unison ring.

The recess 64 and fourth protrusion 58 define a further sprung region, in the form of a further leaf spring, of the bush 40.

The bush 40 includes a chamfer 62 on its inner surface at an edge proximal to the lever arrangement. The chamfer is less than 45 degrees, for example 5 to 30 degrees.

Figure 4:
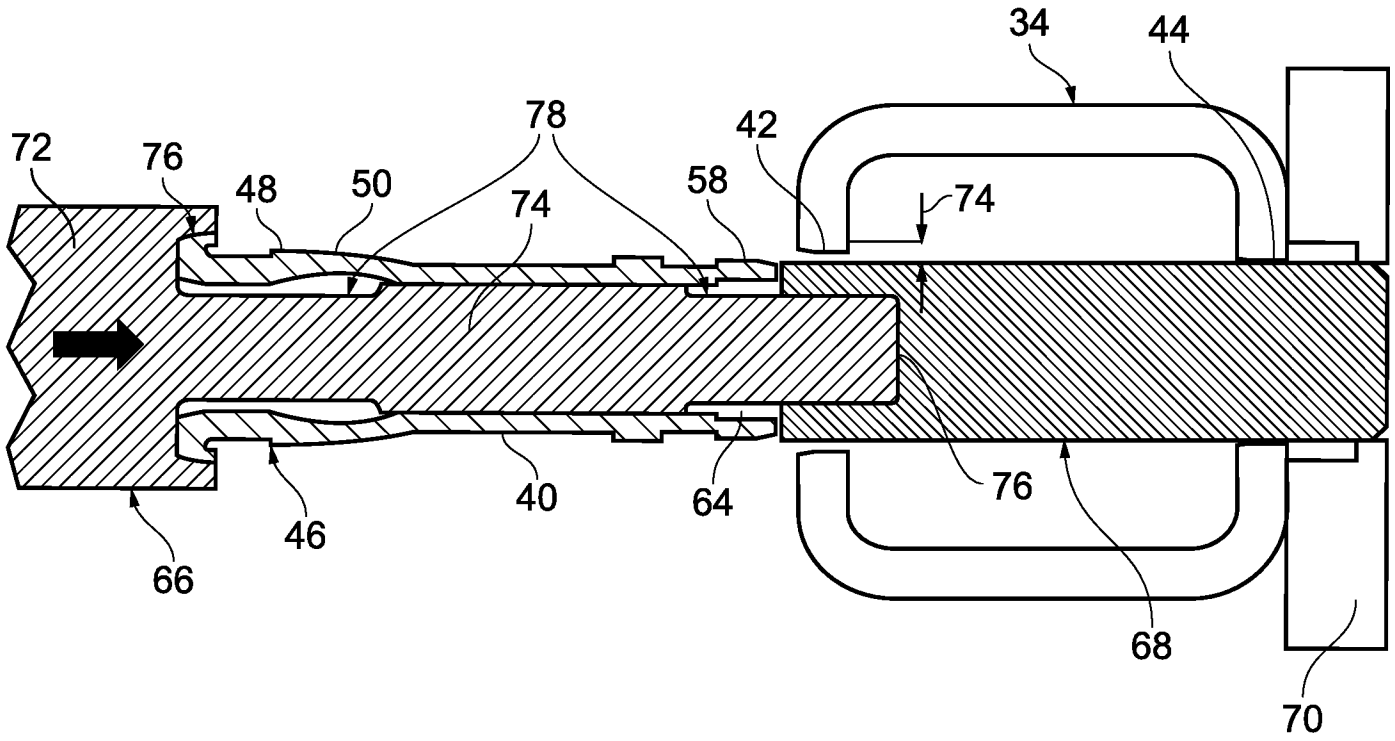
FIG. 4 is a sectional view of a unison ring and bush being assembled using a mandrel and guide bush.

Referring to FIG. 4, to assemble the bush 40 into the unison ring 34, the leaf spring 48 of the bush is deflected away from the unison ring, so as to ease assembly. This deflection may be done using a mandrel 66. The mandrel may be removably connected to a guide 68 that moves through a further guide 70. For example, one end of the mandrel may be received in a recess 76 of the guide 68. The mandrel 66 may include a head 72 and a narrower body 74. The head includes a counterbore 76 adjacent the narrower body. The mandrel also includes recesses 78 at each longitudinal end of the narrower body.

To assemble the bush into the unison ring, the narrower body 74 of the mandrel is positioned through the bush, until the second retention protrusion is received in the counterbore of the mandrel. Receipt of the second retention protrusion in the counterbore causes the leaf spring to deflect.

The guide 76 is then connected to the mandrel by positioning an end of the narrow body into the recess 76 of the guide. The guide is then positioned through the holes in the unison ring and through a hole in the further guide. The mandrel and bush are then pushed through the unison ring until the bush is in the desired position relative to the unison ring (as previously described). The mandrel and guides are then removed.

As the bush is pushed through the hole 44, the end of the bush (i.e. the further leaf spring defined by the protrusion 58 and recess 64) deflects so the bush passes through the hole 44 without damaging the bush. As the first protrusion 48 is pushed through the hole 42 of the unison ring, the ramped surface 50 and leaf spring 46 mean that the bush deflects so that the first protrusion can pass through the hole 44 without causing damage to the bush. The recesses 78 in the mandrel provide a volume into which the sprung regions of the bush can deflect.

During operation of the gas turbine engine, the unison ring can distort, for example during acceleration or deceleration of the engine. In conventional unison ring, lever pin and bush arrangements this distortion of the unison ring can cause the bush to move radially inward relative to the unison ring. In some cases a radially outermost end of the bush may no longer be in contact with the unison ring, and in such cases the pin is free to undesirably tilt, which can impact performance of the variable guide vanes. The unison ring and bush described in the present disclosure address this problem by preventing movement of the bush relative to the unison ring.

The first, second, third and fourth retention protrusions prevent radially inward and outward movement of the bush as the lever pin rotates. In particular, the described bush has an additional retention protrusion (the third retention protrusion) compared to known bushes and the geometry of the protrusions differs.

Figure 5:
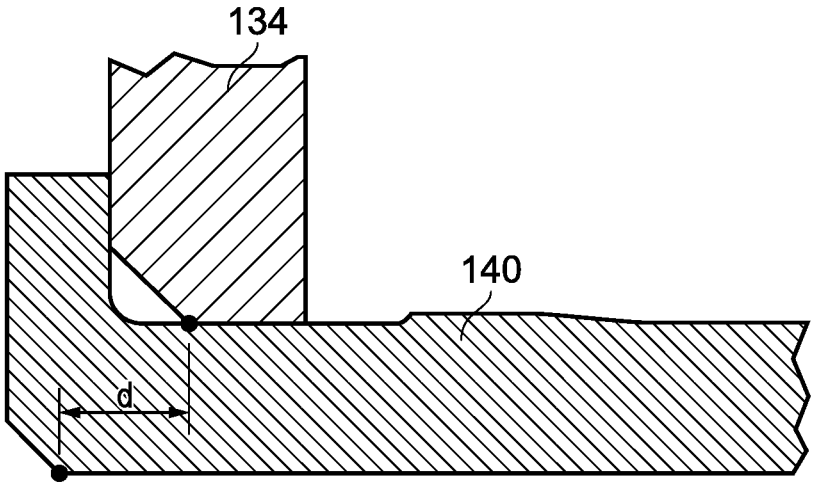
FIG. 5 is a partial sectional view of a unison ring, lever pin and bush assembly which may be conventionally used.
Figure 6:
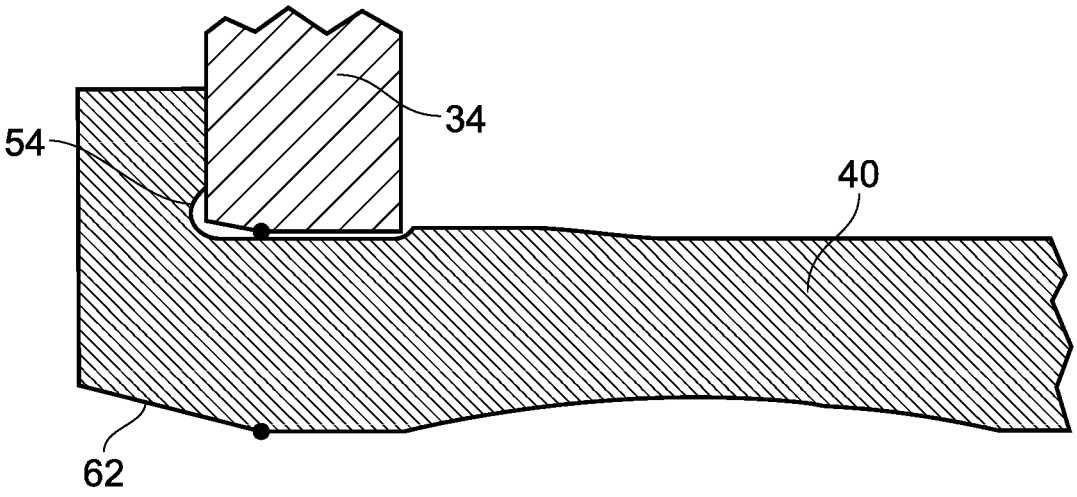
FIG. 6 is a partial sectional view of a unison ring, lever pin and bush assembly of the present disclosure.

Referring to FIGS. 5 and 6, as previously described, the unison ring 34 includes chamfers on the holes 42, 44 which are much shallower than known unison ring and bush arrangements (shown in FIG. 5 with the unison ring indicated at 134 and the bush at 140). The chamfers help to guide the bush into the unison ring, but because they are shallower, the risk of the retention features being shaved off during assembly is reduced. Maintenance of the retention feature is desirable because if the retention features are shaved off during assembly, the rate at which the bush moves radially inward can be increased.

Referring to FIG. 5, in known arrangements there is a large bending moment of the lever pin on the bush because of the spacing d between contact of the bush with the pin and contact of the bush with the unison ring. However, referring to FIG. 6, in the described arrangement the bending moment is removed or significantly reduced. Further, the bush has a thicker wall in a region of the radially inner hole of the unison ring compared to a region of the radially outer hole of the unison ring, and the bush has features such as the chamfer and cannelure which improve support between the unison ring and bush to further reduce any bending moment forces, which could cause the lever pin to break the bush head off.

The provision of a sprung regions means that the bush can deflect during assembly to reduce the risk of the retention features being shaved off during assembly. Further, the ramp provided in the region of the leaf spring, and at the end of the bush further ease assembly and reduce the risk of the retention protrusions being shaved off.

The radially inner hole of the unison ring being larger than the radially outer hole, means that on assembly each retention feature only passes each hole once.

The cannalure 54 can prevent stress raisers under the second retention feature (or flange) and means that the chamfer provided on the hole 42 of the unison ring 34 can be as shallow as possible. This in turn means that the support between the unison ring and the bush can be increased.

The recess 64 provided at an end of the bush furthest from the point of connection of the lever arrangement with the variable guide vanes can further relieve stress to prevent the lever pin from breaking the bush.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

For example, an alternative lever arrangement may connect the variable guide vanes to the unison ring. In such arrangements, the lever pin may extend generally axially rather than generally radially as described.

I claim:

1. A gas turbine engine comprising:

a plurality of variable guide vanes;

a unison ring;

a lever arrangement connecting the unison ring to at least one of the variable guide vanes, wherein the lever arrangement comprises a lever pin received by the unison ring; and a bush provided between the lever pin and the unison ring, wherein the bush comprises a spring biased outwardly away from the lever pin towards the unison ring, wherein the spring and the lever pin define a volume into which the spring is deflected.

2. The gas turbine engine according to claim 1, wherein the spring is adjacent the unison ring at a position proximal to a connection of the lever arrangement with the variable guide vanes.

3. The gas turbine engine according to claim 1, wherein the bush comprises a further spring biased outwardly away from the lever pin towards the unison ring, and wherein the further spring is adjacent the unison ring at a position distal to a connection of the lever arrangement with the variable guide vanes.

4. The gas turbine engine according to claim 1, wherein the spring of the bush defines a leaf spring.

5. The gas turbine engine according to claim 1, wherein an outer surface of the spring of the bush comprises a ramped section which increases in thickness at a position proximal to a point of connection of the lever arrangement with the variable guide vanes.

6. The gas turbine engine according to claim 1, wherein the bush comprises a first retention protrusion adjacent an inner surface of the unison ring and proximal to a connection of the lever arrangement to the variable guide vanes.

7. The gas turbine engine according to claim 6, wherein the first retention protrusion is defined by an outer surface of the spring.

8. The gas turbine engine according to claim 1, wherein the bush comprises a second retention protrusion adjacent an outer surface of the unison ring and proximal to a connection of the lever arrangement to the variable guide vanes.

9. The gas turbine engine according to claim 8, wherein the second retention protrusion defines a flange having a cannelure, the cannelure including a groove extending into the flange.

10. The gas turbine engine according to claim 1, wherein the bush comprises a third retention protrusion adjacent an inner surface of the unison ring and distal to a connection of the lever arrangement to the variable guide vanes.

11. The gas turbine engine according to claim 1, wherein the bush comprises a fourth retention protrusion adjacent an outer surface of the unison ring and distal to a connection of the lever arrangement to the variable guide vanes.

12. The gas turbine engine according to claim 1, wherein the unison ring defines a first hole proximal to the connection of the lever arrangement with the variable guide vanes and a second hole distal to the connection of the lever arrangement with the variable guide vanes, the lever pin and bush being received through the first hole and the second hole, and wherein the first hole has a larger diameter than the second hole.

13. The gas turbine engine according to claim 12, wherein the bush has a greater thickness in a region aligned with the first hole than in a region aligned with the second hole.

14. The gas turbine engine according to claim 1, wherein the unison ring defines a first hole proximal to the connection of the lever arrangement with the variable guide vanes and a second hole distal to the connection of the lever arrangement with the variable guide vanes, the lever pin and bush being received through the first hole and the second hole, and wherein a chamfer is provided around the edge of the first hole and the second hole, the chamfer being at an angle of 5 to 30 degrees to an axis parallel to a longitudinal axis of the gas turbine engine.

15. The gas turbine engine according to claim 1, wherein the bush includes a recess at one or both longitudinal ends.

16. A method of manufacturing a gas turbine engine having a plurality of variable guide vanes, a unison ring, a lever arrangement connecting the unison ring to the variable guide vanes, wherein the lever arrangement comprises a lever pin received by the unison ring, and a bush provided between the lever pin and the unison ring, wherein the bush comprises a spring biased outwardly away from the lever pin and towards the unison ring, wherein the spring and the lever pin define a volume into which the spring is deflected, the method comprising:

compressing the spring of the bush and inserting the bush into the unison ring whilst the spring is compressed.

17. The method according to claim 16, wherein the spring is compressed using a mandrel.

18. The method according to claim 17, wherein the mandrel is received in a guide that guides the mandrel and bush through the unison ring.

19. A gas turbine engine comprising:

a plurality of variable guide vanes;

a unison ring;

a lever means for connecting the unison ring to at least one of the variable guide vanes, wherein the lever means comprises a pinning means received by the unison ring; and a bush provided between the pinning means and the unison ring, wherein the bush comprises a first sprung means for spring biasing the bush outwardly away from the pinning means towards the unison ring, wherein the first sprung means and the pinning means define a volume into which the first sprung means is deflected.

20. The gas turbine engine according to claim 19, wherein the bush comprises a second sprung means for spring biasing the bush outwardly away from the pinning means towards the unison ring, and wherein the first sprung means is adjacent the unison ring at a position proximal to a connection of the lever means with the variable guide vane and the second sprung means is adjacent the unison ring at a position distal to a connection of the lever means with the variable guide vane.

* * * * *